US005758547A

United States Patent [19]

Smale

[11] Patent Number: 5,758,547

[45] Date of Patent: Jun. 2, 1998

[54] SELF-ADJUST VARIABLE RATIO PARKING BRAKE ACTUATOR

[75] Inventor: Randall D. Smale, Farmington Hills, Mich.

[73] Assignee: Dura Automotive Systems, Rochester Hills, Mich.

[21] Appl. No.: 627,726

[22] Filed: Apr. 2, 1996

[51] Int. Cl.[6] ..... G05G 1/14

[52] U.S. Cl. ..... 74/516; 74/529; 74/540

[58] Field of Search ..... 74/512, 516, 517, 74/518, 529, 530, 540

[56] References Cited

U.S. PATENT DOCUMENTS

| | | | |
|---|---|---|---|
| 3,961,545 | 6/1976 | Petresh et al. . | |
| 4,440,269 | 4/1984 | Harriott . | |
| 5,211,072 | 5/1993 | Barlas et al. . | |
| 5,309,786 | 5/1994 | Pare et al. | 74/516 X |

*Primary Examiner*—Charles A. Marmor
*Assistant Examiner*—Mary Ann Battista
*Attorney, Agent, or Firm*—David A. Greenlee

[57] ABSTRACT

A foot-operated parking brake actuator applies a parking brake by moving an input pedal lever between a brake-released position and a plurality of brake-applied positions to operate a cable to apply and release a vehicle parking brake. A mounting bracket pivotally mounts the pedal for pivotal movement about a first pivot. A sector gear is secured to the bracket with its center on the first pivot, and mounts a cable take-up reel. The cable is attached to the reel which is pivotally mounted on the pedal lever about a second pivot. A pinion is secured to the reel for engagement with the sector gear upon pedal lever movement to brake-apply positions to wind the cable on the reel. Cable winding occurs at a sequence of variable input/output force ratios of input pedal lever force to output cable force or load to apply the parking brake, the ratio varying with pedal movement because of the complex movement of the reel. The pinion disengages from the sector gear in brake-release position to enable automatic slack adjustment. The sequence of variable input/output force ratios is a selected segment of a larger predetermined sequence of variable force ratios determined by the size and relative positioning of the sector gear, the pinion, the pedal lever, and the rotational position of the cable attachment point on the pinion relative to the cable entry.

5 Claims, 3 Drawing Sheets

FIG 2
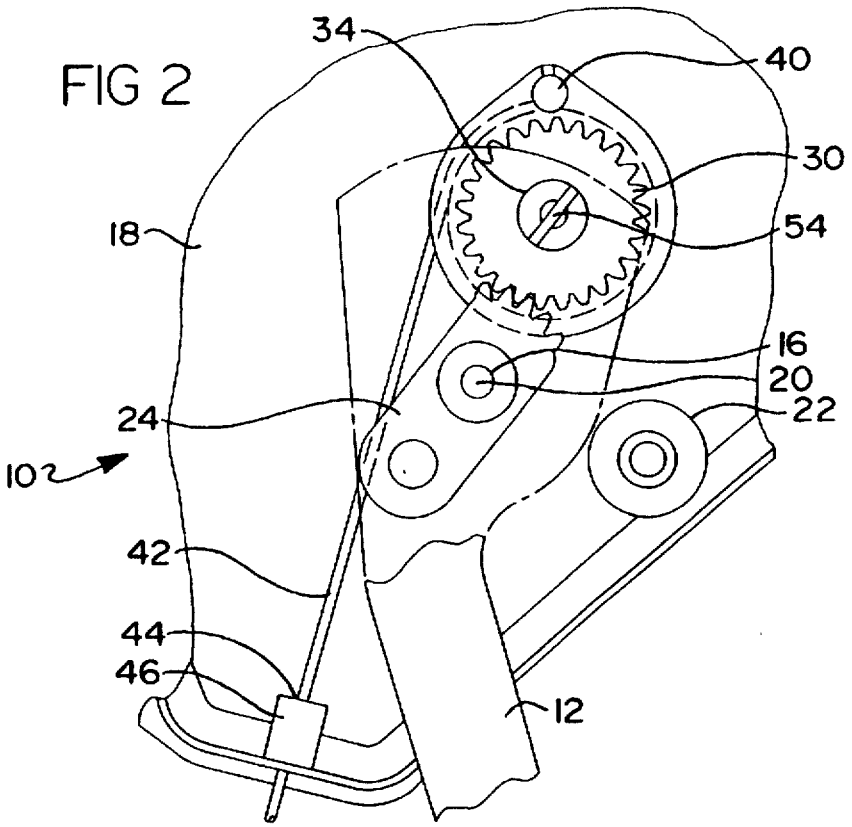
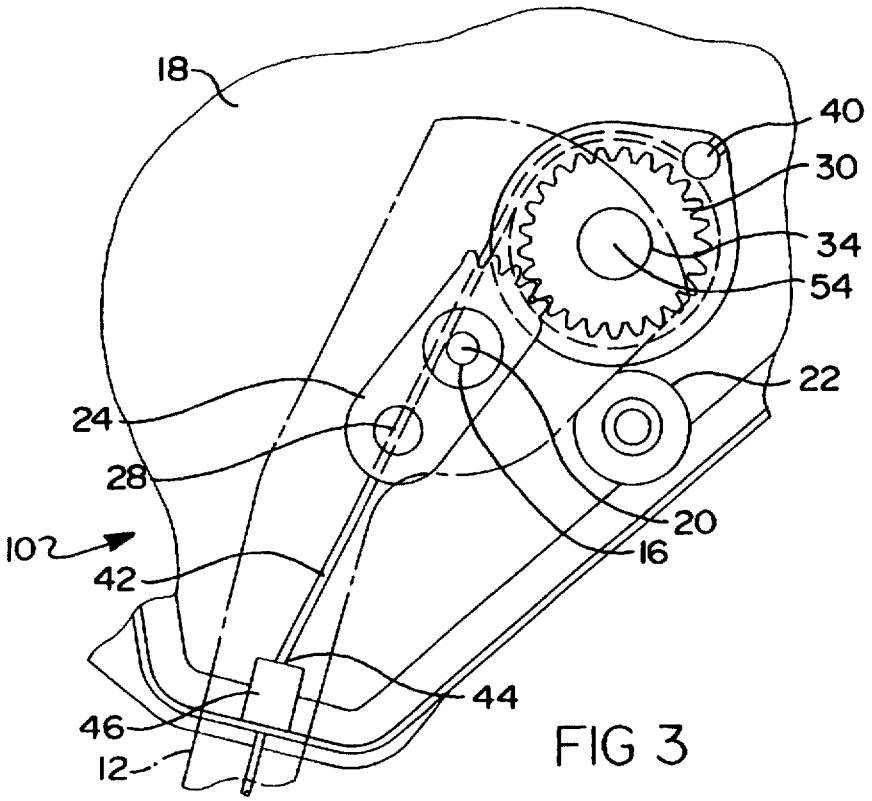
FIG 3

SELF-ADJUST VARIABLE RATIO PARKING BRAKE ACTUATOR

BACKGROUND OF THE INVENTION

This invention relates generally to parking brake actuators and, more particularly, to a foot-operated parking brake actuator having a variable ratio input pedal force and output cable force that includes a self-adjust feature.

Foot-operated parking brake actuators are increasing in popularity because of ease of operation and location. These actuators are located beneath the vehicle instrument panel to the left of the steering column. The parking brake is set by the driver depressing the pedal with his left foot. It is released by moving a manual lever or by shifting the automatic transmission lever out of PARK.

Because of increasingly stringent mandated fuel economy requirements, automobiles are being designed to be more compact to make them increasingly lighter. Design problems are caused by the necessity of providing an automobile that is exteriorly smaller, but not interiorly smaller. This requires packaging all components into a shrinking space.

As a result of this downsizing, there is less space in which to mount and operate the parking brake actuator. There are limits on the amount of space available for pedal travel during applying and releasing the parking brake. This has caused a proliferation of parking brake actuator designs, including multi-pump units that require multiple, short-travel pedal depressions, and variable ratio units that feature initial high cable travel per unit of pedal travel, to increasingly shorter cable travel per unit travel of increasingly longer pedal travel, thus varying the mechanical advantage or ratio of input to output forces.

Constant ratio actuators have a constant mechanical advantage, or input/output force ratio, and a constant amount of cable take-up per unit of pedal travel. As such, they require an increasing input force due to the increasing load caused by tensioning of the cable during application. Since manufacturers place limits on maximum input force, a large mechanical advantage and large pedal travel is usually required to fully apply the parking brake. The amount of pedal travel required for parking brake application can be lengthened by cable variations at installation and by cable stretch during use over the life of the vehicle.

Because they constantly vary the input/output force ratio, variable ratio actuators enable a more convenient leveling of input force required to apply the parking brake throughout pedal travel. This results from increasing the mechanical advantage as the parking brake is applied. These actuators typically do not include an automatic self-adjust feature. They also cannot offer various ratios to tailor the same actuator to a variety of different applications having different force and pedal travel requirements.

It would be desirable to provide a variable ratio parking brake actuator having a self-adjust feature.

It would also be desirable to provide such a parking brake actuator that can vary the input/output force ratios by merely re-orienting the actuator components to enable tailoring the actuator to a variety of different applications each having different force and pedal travel requirements.

SUMMARY OF THE INVENTION

It is therefore an object of this invention to provide a variable ratio parking brake actuator having a self-adjust feature.

Another object of this invention is to provide such a parking brake actuator that can vary the input/output force ratios by merely re-orienting the actuator components to enable tailoring the actuator to a variety of different applications each having different force and pedal travel requirements.

In one aspect, this invention features a foot-operated parking brake actuator for applying a parking brake by moving an input pedal lever between a brake-released position and a plurality of brake-applied positions to operate a cable to apply and release a vehicle parking brake. The actuator has a bracket pivotally mounting one end of the pedal for pivotal movement about a first pivot. A sector gear is fixedly secured to the bracket with its center on the first pivot, and mounts a cable take-up reel which secures one end of the cable at an attachment point on its periphery. The reel is mounted on the pedal lever for movement therewith and for rotation relative thereto about a second pivot on the pedal lever. A pinion is secured to the take-up reel for rotation therewith to take up the cable when rotated by engagement with the sector gear upon pedal lever movement from brake-release to brake-apply positions. This winds the cable on the reel at a sequence of variable ratios of pedal lever movement per unit of cable movement to vary the input/output force ratio as the parking brake is applied, the ratio varying with pedal movement. The pinion disengages from the sector gear upon pedal lever movement to brake-release position to enable automatic adjustment for changes in cable length.

In another aspect, this invention features a sequence of variable input/output force ratios which is a segment of a larger predetermined sequence of variable ratios determined by the relative positioning and size of the sector gear and pinion, length of the pedal lever, and the rotational position of the attachment point on the pinion relative to the cable entry to the bracket.

These and further objects and features of this invention will become more readily apparent upon reference to the following detailed description of a preferred embodiment, as illustrated in the accompanying drawings, in which:

BRIEF DESCRIPTION OF THE DRAWINGS

FIG. 2 is a partial view similar to FIG. 1, with the actuator shown in a brake applied position;

FIG. 3 is a partial view similar to FIG. 1, with the actuator shown in a further brake applied position.

DETAILED DESCRIPTION OF A PREFERRED EMBODIMENT

Figure 1:
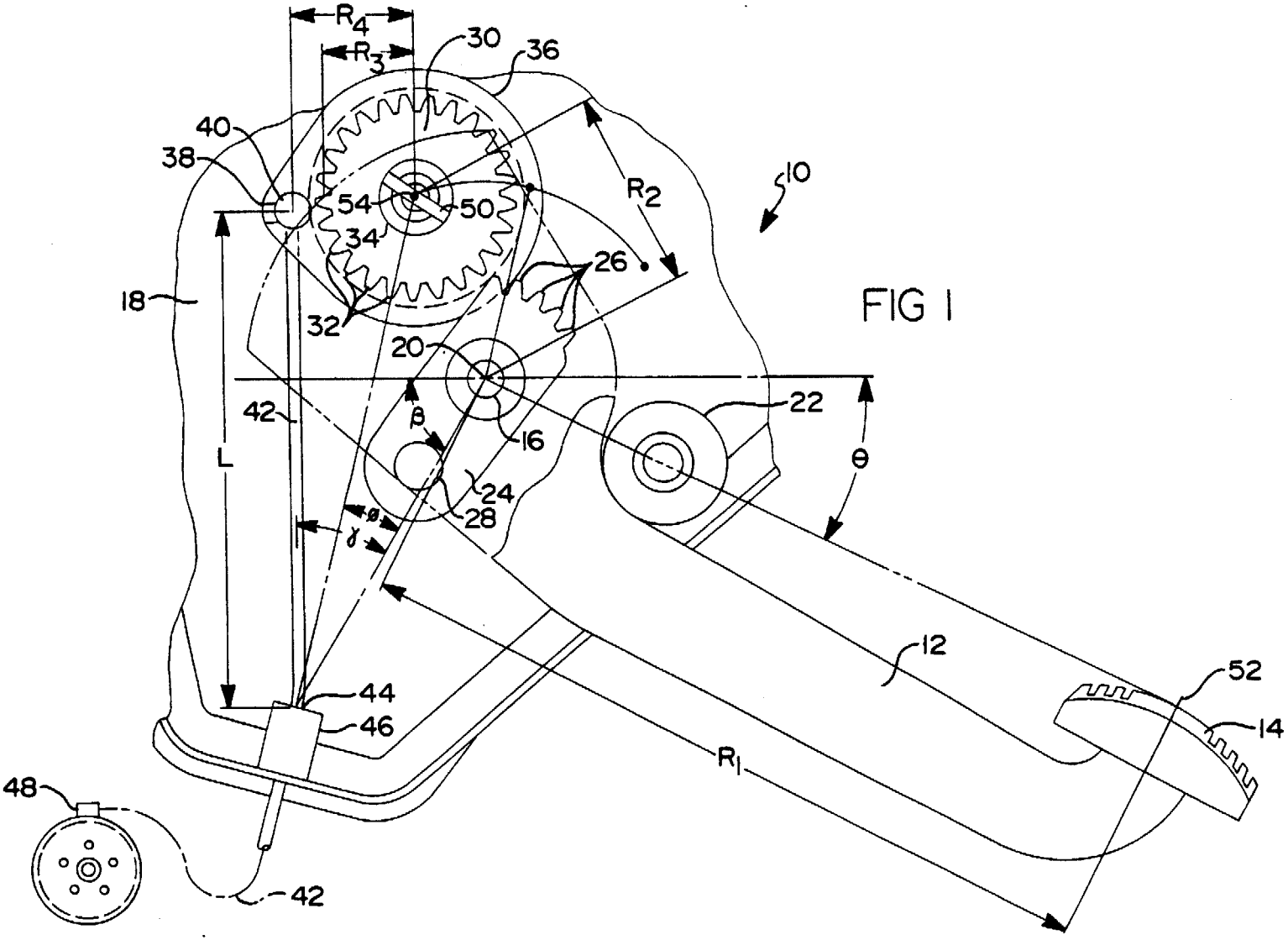
FIG. 1 is an elevational view of a foot-operated parking brake actuator according to this invention, illustrating the relative relationships of the elements, with the actuator shown in brake-release position.

Referring now to FIG. 1 of the drawings, a foot-operated parking brake actuator 10 includes a pedal lever 12 that has a foot pad 14 mounted on its outer end for engagement by a vehicle driver's foot (not shown). Pedal lever 12 is mounted by a pin 16 to a mounting bracket 18 for pivotal movement about a pivot point 20. Bracket 18 is secured to a vehicle beneath the vehicle instrument panel (not shown) for operation. A rubber stop member 22 is mounted on bracket 18 to engage and position pedal lever 12 in the brake-release position of FIG. 1.

A sector 24 having teeth 26 is journaled about pivot pin 16 and is immovably secured to mounting bracket by a pin 28. A pinion 30 having peripheral teeth 32 is rotatably secured to a pin 34 carried by the inner end of pedal lever 12. A cable take-up reel 36 is affixed to pinion 30 for rotation therewith on pivot pin 34. Thus take-up reel 36 and pinion 30 rotate with pedal lever 12 and are rotatable about pivot pin 34 relative to pedal lever 12. Take-up reel 36 includes an attachment slot 38 which receives the end 40 of a parking brake cable 42 that extends through an entry aperture 44 of a fitting 46 in housing 18 to a parking brake 48.

A take-up clock spring 50 is wrapped about pivot pin 34 and has one end (not shown) attached to pinion 30 and its other end secured to pivot pin 34 to bias pinion 30 clockwise, as viewed in the drawings. In the brake-release position of FIG. 1, pinion 30 and take-up reel 36 are free to rotate under the influence of spring 50. This tends to wind cable 42 on reel 36 to take up any cable slack.

When it is desired to apply parking brake 48, pedal lever 12 is depressed by applying a force at the lever actuation point 52 on foot pad 14. This pivots lever 12 clockwise about pivot pin 16, carrying pinion 30 with it After a short travel of lever 12, pinion teeth 32 begin to engage sector teeth 26 to impart a complex movement to take-up reel 36. Further travel of pedal lever 12 will not only rotate pinion 30 on pin 16 about pivot point 20, but will also rotate pinion 30 on pin 34 about its pivot point 54 to wind cable 42 on take-up reel 36, as shown in FIG. 2. Further depression of pedal lever 12 to a brake-applied position illustrated in FIG. 3 winds cable 42 on take-up reel 36.

Pedal lever 12 is then locked in brake-applied position by conventional means (not shown), such as shown in U.S. Pat. No. 3,333,512 to Parsons. When it is desired to release parking brake 48, pedal lever 12 is conventionally released, allowing it to return to the FIG. 1 position where it engages stop 22.

The rate of cable take-up per cable movement, and the ratio of input pedal lever force to output cable force or load to apply parking brake 48, vary as lever 12 is depressed. This input/output force ratio depends on both the movement of cable end 40 relative to aperture 44 and the movement of cable end 40 about pivot pin 34. The ratio of input force to output force varies in a predetermined sequence, which is calculated as follows.

The geometry and dimensions of the elements of parking brake actuator 10 which determine the input/output force ratio are shown in FIG. 1, where $R_1$=effective length of pedal lever 12 from pivot point 20 to actuation point 50

$R_2$=distance between sector gear pivot point 20 and pinion pivot point 54

$R_3$=pitch radius of pinion 30

$R_4$=radius of take-up reel 36

$\phi$=angle between a line connecting cable entry 44 & sector pivot point 20 and a line connecting cable entry 44 & pinion pivot point 54

$\gamma$=angle between a line connecting cable entry 44 & sector pivot point 20 and cable 42

$\beta$=angle between a line connecting cable entry 44 & sector pivot point 20 and the horizontal $\theta$=angle between pedal lever 12 and the horizontal.

The input/output force ratio of the parking brake actuator of this invention is expressed by the following equation:

$$\text{Ratio} = \frac{R_1}{R_2\left[\frac{R_4}{R_3} + \cos(\gamma + \beta + \theta - 90)\right]}$$

Figure 4:
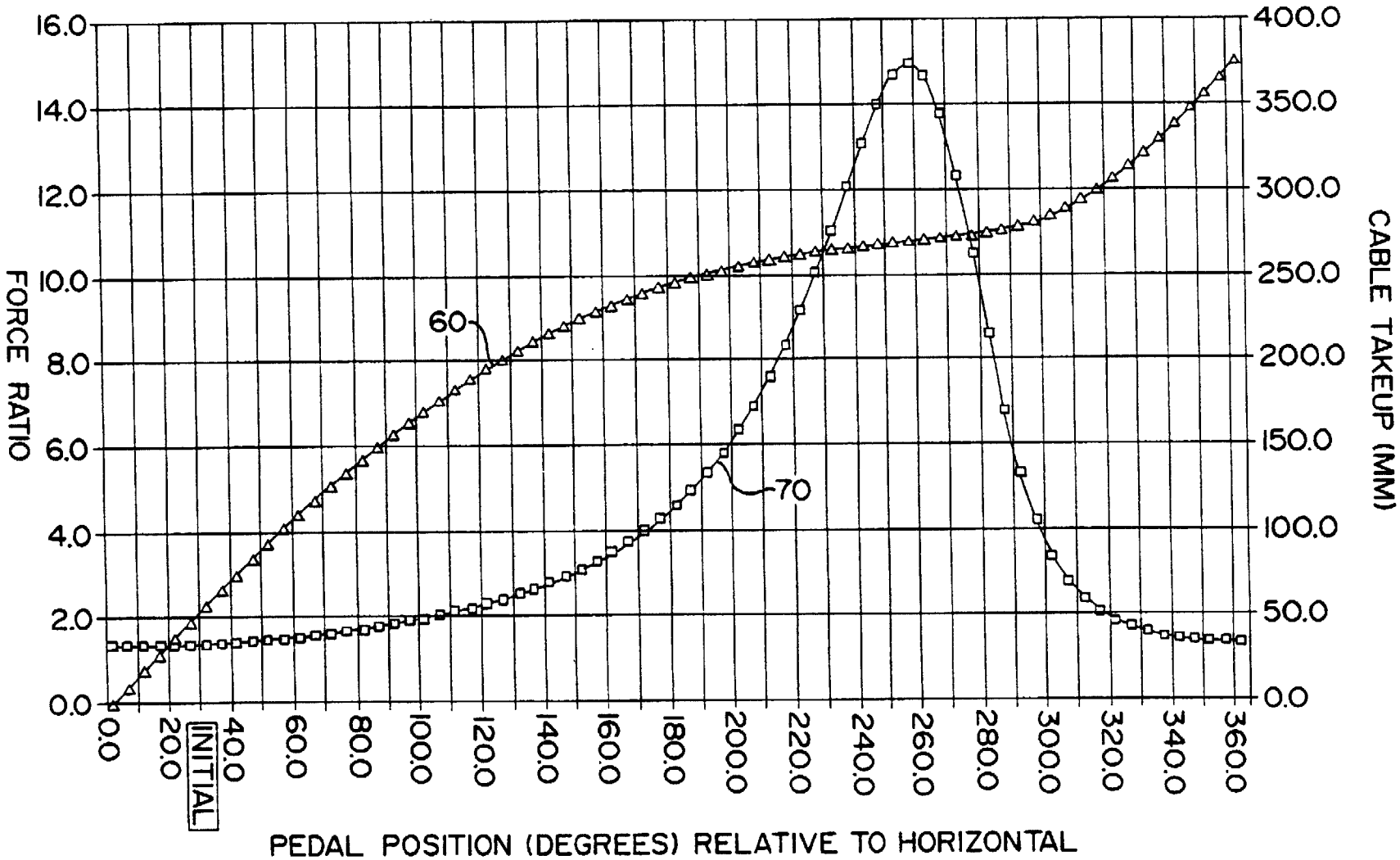
FIG. 4 is a chart plotting input/output force ratio and cable take-up against pedal travel.

FIG. 4 is a chart which plots the input/output force ratio and cable take-up as functions of pedal travel Here, the abscissa shows pedal travel in degrees of rotation, the left ordinate shows the ratio of input pedal force to output cable force or load, and the right ordinate shows cable take-up, expressed in millimeters (mm). Cable take-up is plotted by curve 60, while the varying input/output force ratio is plotted by curve 70.

In one illustrative example, a parking brake actuator according to this invention has its components dimensioned as follows:

$R_1$=150.00 mm $R_2$=50.00 mm $R_3$=25.00 mm $R_4$=30.00 mm

At the initial, brake-release position shown in FIG. 1, the pedal lever is depressed 30° from the horizontal and the components have the following base line angular relationships:

$\gamma$=39.70°

$\beta$=69.17° (constant)

$\theta$=30.00°, which results in an initial calculated force ratio of 1.6.

After movement of the pedal lever an additional 20° to an partial brake applied position of the pedal lever, between the illustrated positions of FIGS. 1 and 2, $\gamma$=32.9° and $\theta$=50.00°. This results in force a ratio increase to 1.8 and cable travel, or take-up of 30.8 mm to begin applying the parking brake.

At the FIG. 2 position, the pedal lever has travelled an additional 45°; now $\gamma$=24.1° and $\theta$=75.00°, resulting in a force ratio increase to 2.1 and an additional 33.5 mm of cable take-up to further apply the parking brake.

At the brake fully-applied FIG. 3 position of the pedal lever, $\gamma$=8.6° and $\theta$=120.00°, resulting in a force ratio increase to 3.4 and 45.2 mm of cable take-up to further apply the parking brake.

Because of the complex geometry of cable take-up, caused by the simultaneous movement of pinion 30 about both pivot points 20 and 54, it is seen that cable take-up initially increases rapidly during the initial 130° of pedal travel, then tapers off. The input/output force ratio, as calculated by the above equation, increases slowly during that initial 130°, then increases rapidly, and finally decreases rapidly as take-up reel pivot point 54 rotates about pedal pivot point away from and then toward cable entry at aperture 44. It is readily apparent that cable travel and input/output force ratio have an inverse relationship.

The input force required to take up cable is initially low as slack in the parking brake is taken up and the cable begins to tension. The required force then rises rapidly as the brake is applied. Use of the initial segments of the illustrated curves provides parking brake actuator operation tailored to input force requirements. There is initial rapid cable take-up at a slightly increasing force ratio during the period of low force requirements, and terminal lesser cable take-up at a rapidly increasing force ratio which coincides with rapidly increasing force requirements due to cable tensioning.

Both curves 60 and 70 are plotted for a complete 360° rotation of pedal lever 12, assuming a more extensive sector gear 24). Although 360° operation is operationally impractical, the full plot enables selection of any portion of the curves to tailor a single parking brake actuator 10 for use in any particular vehicle application by selecting an initial pedal lever position.

The input/output force ratio can also be varied by changing the initial position of the cable attachment point 38 on take-up reel 36, varying dimensions, and varying the initial position of pinion 30 relative to pivot point 20. However, the input/output force ratios are still calculated by the above equation, despite the changes.

While only a preferred embodiment has been illustrated and described, obvious modifications thereof are contemplated within the scope of this invention and the following claims.

We claim:

1. A foot-operated parking brake actuator having an input pedal lever movable between a brake-released position and a plurality of brake-applied positions to operate a cable to apply and release a vehicle parking brake, comprising, a bracket pivotally mounting the pedal lever for pivotal movement about a first pivot point, a sector gear fixedly secured to the bracket with its center on the first pivot point, a cable take-up reel which secures one end of the cable at an attachment point on its periphery, the reel being mounted on the pedal lever for movement therewith and for rotation relative thereto about a second pivot point on the pedal lever, a pinion secured to the take-up reel for rotation therewith to take up the cable, the pinion being engageable with the sector gear for rotation thereby about a third pivot point upon pedal lever movement from brake-release to brake-apply positions, whereby the cable attachment point moves through a sequence of rotational positions to wind the cable on the reel at a sequence of variable ratios of input pedal force output to cable force to apply the parking brake, said ratio varying with pedal movement.

2. The foot-operated parking brake actuator of claim 1, wherein the pinion and the sector gear are mounted so that the pinion disengages from the sector gear upon pedal lever movement to brake-release position to enable automatic adjustment for changes in cable length.

3. The foot-operated parking brake actuator of claim 2, wherein the bracket includes a cable entry aperture through which the cable moves during operation of the pedal lever.

4. The foot-operated parking brake actuator of claim 3, wherein the sequence of variable ratios includes a force ratio at each pedal lever position which is determined by the equation:

$$\text{Ratio} = \frac{R_1}{R_2\left[\frac{R_4}{R_3} + \cos(\gamma + \beta + \theta - 90)\right]}$$

where:

$R_1$=effective pedal lever length $R_2$=distance between the first and third pivot points $R_3$=pinion pitch radius $R_4$=take-up reel radius $\gamma$=angle between a line connecting the cable entry aperture & the first pivot point and the cable $\beta$=angle between a line connecting the cable entry aperture & the first pivot point and the horizontal $\theta$=angle between the pedal lever and the horizontal.

5. The foot-operated parking brake actuator of claim 4, wherein said sequence of variable ratios of input pedal force to output cable force is a segment of a larger predetermined sequence of variable ratios determined by the relative positioning of the sector gear and the pinion, the relationship between $R_1$, $R_2$, $R_3$ and $R_4$, and the rotational position of the cable attachment point on the pinion relative to the cable entry.

* * * * *